US007180465B2

(12) United States Patent
Lynch et al.

(10) Patent No.: US 7,180,465 B2
(45) Date of Patent: Feb. 20, 2007

(54) COMPACT SMART ANTENNA FOR WIRELESS APPLICATIONS AND ASSOCIATED METHODS

(75) Inventors: Michael J. Lynch, Merritt Island, FL (US); Thomas Liu, Melbourne, FL (US); Bing A. Chiang, Melbourne, FL (US); Govind R. Kadambi, Melbourne, FL (US)

(73) Assignee: InterDigital Technology Corporation, Wilmington, DE (US)

( * ) Notice: Subject to any disclaimer, the term of this patent is extended or adjusted under 35 U.S.C. 154(b) by 0 days.

(21) Appl. No.: 11/201,789

(22) Filed: Aug. 11, 2005

(65) Prior Publication Data

US 2006/0044205 A1 Mar. 2, 2006

Related U.S. Application Data

(60) Provisional application No. 60/601,740, filed on Aug. 13, 2004, provisional application No. 60/601,482, filed on Aug. 13, 2004.

(51) Int. Cl.

| | |
|---|---|
| ***H01Q 1/24*** | (2006.01) |
| ***H01Q 9/38*** | (2006.01) |
| ***H01Q 19/00*** | (2006.01) |
| ***H01Q 1/50*** | (2006.01) |

(52) U.S. Cl. ..... 343/833; 343/702; 343/829; 343/850

(58) Field of Classification Search ..... 343/702, 343/829, 833, 834, 850

See application file for complete search history.

(56) References Cited

U.S. PATENT DOCUMENTS

| | | | | |
|---|---|---|---|---|
| 2,505,751 | A * | 5/1950 | Bolljahn | 343/708 |
| 3,846,799 | A | 11/1974 | Gueguen | 343/833 |
| 5,497,167 | A * | 3/1996 | Luoma | 343/828 |
| 5,905,473 | A | 5/1999 | Taenzer | 343/834 |
| 6,369,770 | B1 | 4/2002 | Gothard et al. | 343/794 |
| 6,753,826 | B2 | 6/2004 | Chiang et al. | 343/834 |
| 6,876,331 | B2 | 4/2005 | Chiang et al. | 343/702 |

OTHER PUBLICATIONS

Ohira et al., Electronically Steerable Passive Array Radiator Antennas for Low-Cost Analog Adaptive Beamforming, 0-7803-6345-0/00, 2000, IEEE.

Scott et al., Diversity Gain From a Single-Port Adaptive Antenna Using Switched Parasitic Elements Illustrated with a Wire and Monopole Prototype, IEEE Transactions on Antennas and Propagation, vol. 47, No. 6, Jun. 1999.

King, The Theory of Linear Antennas, pp. 622-637, Harvard University Press, Cambridge, Mass., 1956.

Lo et al., Antenna Handbook: Theory, Applications and Design, pp. 21-38, Van Nostrand Reinhold Co., New York, 1988.

* cited by examiner

*Primary Examiner*—Shih-Chao Chen
(74) *Attorney, Agent, or Firm*—Allen, Dyer, Doppelt, Milbrath & Gilchrist, P.A.

(57) ABSTRACT

A smart antenna includes an active antenna element, a passive antenna element laterally adjacent the active antenna element, and an impedance element selectively connectable to the passive antenna element for antenna beam steering. A ground plane includes a center portion adjacent the active antenna element, and first and second arms extending outwardly from the center portion. The first arm is connected to the impedance element, and the second arm is laterally adjacent the first arm.

35 Claims, 7 Drawing Sheets

COMPACT SMART ANTENNA FOR WIRELESS APPLICATIONS AND ASSOCIATED METHODS

RELATED APPLICATIONS

This application claims the benefit of U.S. Provisional Application Ser. Nos. 60/601,740 filed Aug. 13, 2004 and 60/601,482 filed Aug. 13, 2004, the entire contents of which are incorporated herein by reference.

FIELD OF THE INVENTION

The present invention relates to the field of wireless communications, and more particularly, to a compact smart antenna for use with a wireless communications device.

BACKGROUND OF THE INVENTION

In wireless communications systems, communications devices communicate with a centrally located base station within a cell. The wireless communications system may be a CDMA2000 or GSM communications system, for example. The mobile communications device is typically a hand-held device, such as a cell telephone, for example. Communications devices also communicate with access points by making use of wireless local area network (WLAN) protocols. For example, the communications device may be a PCMCIA card (Personal Computer Memory Card International Association) or a USB adaptor compatible with the 802.11 standards.

In some embodiments, the antenna protrudes from the housing or enclosure of the communications device. The antenna may be a protruding monopole or dipole antenna, for example. A monopole or dipole antenna is limited to a fixed pattern, such as an omni-directional antenna pattern.

Another type of antenna used with communications devices is a switched beam antenna. A switched beam antenna system generates a plurality of antenna beams including an omni-directional antenna beam and one or more directional antenna beams. Directional antenna beams provide higher antenna gains for advantageously increasing the communications range of the communications device and for also increasing network throughput. A switched beam antenna is also known as a smart antenna or an adaptive antenna array.

U.S. Pat. No. 6,876,331 discloses a smart antenna for a communications device, such as a cell phone. This patent is assigned to the current assignee of the present invention, and is incorporated herein by reference in its entirety. In particular, the smart antenna includes an active antenna element and a plurality of passive antenna elements protruding from the housing of the cell phone. A ground plane is adjacent the active and passive antenna elements.

The overall height of the smart antenna is determined by the height of the active and passive antenna elements and the height of the corresponding ground plane. This in turn affects the overall height of the wireless communications device carrying the smart antenna. As technology reduces the size of the wireless communications devices, there is a demand to provide a more compact smart antenna.

SUMMARY OF THE INVENTION

In view of the foregoing background, it is therefore an object of the present invention to provide a compact smart antenna for wireless communications devices.

This and other objects, features, and advantages in accordance with the present invention are provided by a smart antenna comprising an active antenna element, at least one passive antenna element laterally adjacent the active antenna element, and at least one impedance element selectively connectable to the at least one passive antenna element for antenna beam steering. The compact smart antenna further comprises a ground plane comprising a center portion adjacent the active antenna element, at least one first arm extending outwardly from the center portion and connected to the at least one impedance element, and at least one second arm laterally adjacent the at least one first arm and extending outwardly from the center portion.

The first and second arms of the ground plane advantageously allow the overall height of the ground plane to be reduced, which in turn, reduces the overall height of the smart antenna. In particular, the first arm may define a resonant frequency so that performance of the smart antenna is not significantly affected. When the first arm is resonant, it stops the current in the ground plane from conducting any further, thus restricting the effect of human interaction. Another advantage of the first arm is that the second arm can be extended in length without significantly affecting the radiation pattern.

The first and second arms may be parallel to one another, and they may also be orthogonal to the passive antenna element. The first arm may extend outwardly from the center portion greater than the second arm.

The first and second arms may each have a rectangular shape. Alternatively, the first arm may have a meandering shape or a helix shape, for example. In addition, the first arm may have an L-shape. In this embodiment, the first arm comprises a first portion connected to the impedance element and a second portion connected thereto for defining the L-shape. The second portion may include an inverted L-shaped end.

The smart antenna may further comprise at least one switch for selectively connecting the passive antenna element to the impedance element. The active antenna element may have a T-shape. The passive antenna element may comprise an inverted L-shaped portion laterally adjacent the active antenna element.

The smart antenna may further comprise a dielectric substrate. The active antenna element, the passive antenna element, impedance element and the ground plane may be formed on the dielectric substrate.

Another aspect of the present invention is directed to a communications device comprising a smart antenna as defined above for generating a plurality of antenna beams, a beam selector controller connected to the smart antenna for selecting one of the plurality of antenna beams, and a transceiver connected to the beam selector.

Yet another aspect of the present invention is directed to a method for making a smart antenna comprising forming at least one passive antenna element laterally adjacent an active antenna element, and forming at least one impedance element selectively connectable to the at least one passive antenna element for antenna beam steering. The method further comprises forming a ground plane comprising a center portion adjacent the active antenna element, and at least one first arm extending outwardly from the center portion and connected to the at least one impedance element. At least one second arm is formed laterally adjacent the at least one first arm and extends outwardly from the center portion.

DETAILED DESCRIPTION OF THE PREFERRED EMBODIMENTS

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout, and prime and double prime notations are used to indicate similar elements in alternative embodiments.

Figure 1:
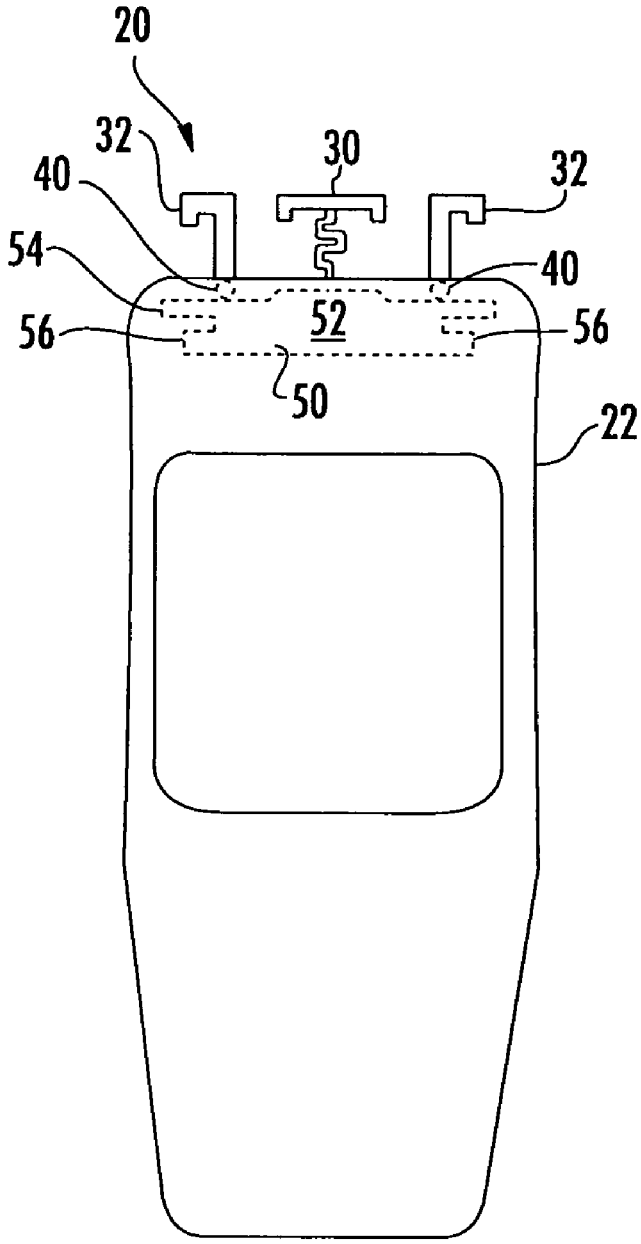
FIG. 1 is a schematic diagram of a cell phone with a smart antenna in accordance with the present invention.
Figure 2:
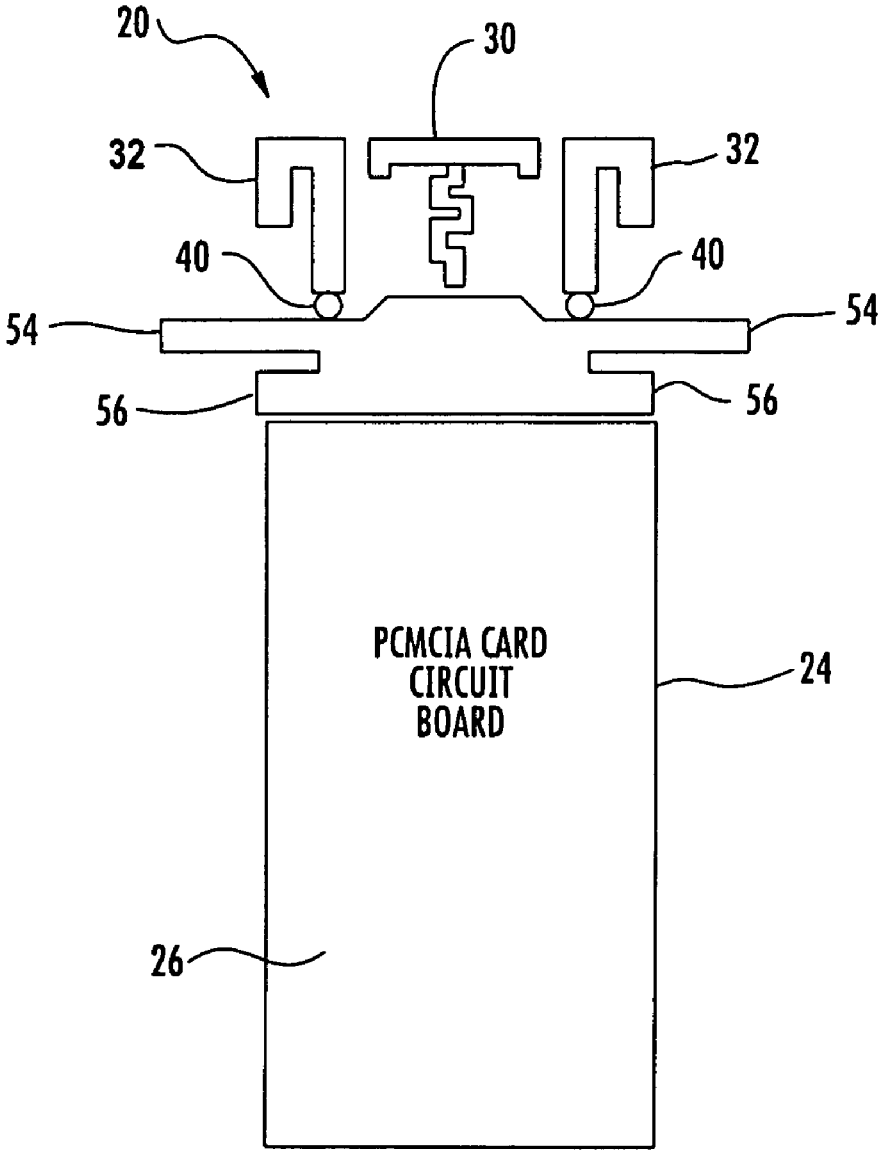
FIG. 2 is a schematic diagram of a PCMCIA card with a smart antenna in accordance with the present invention.
Figure 3:
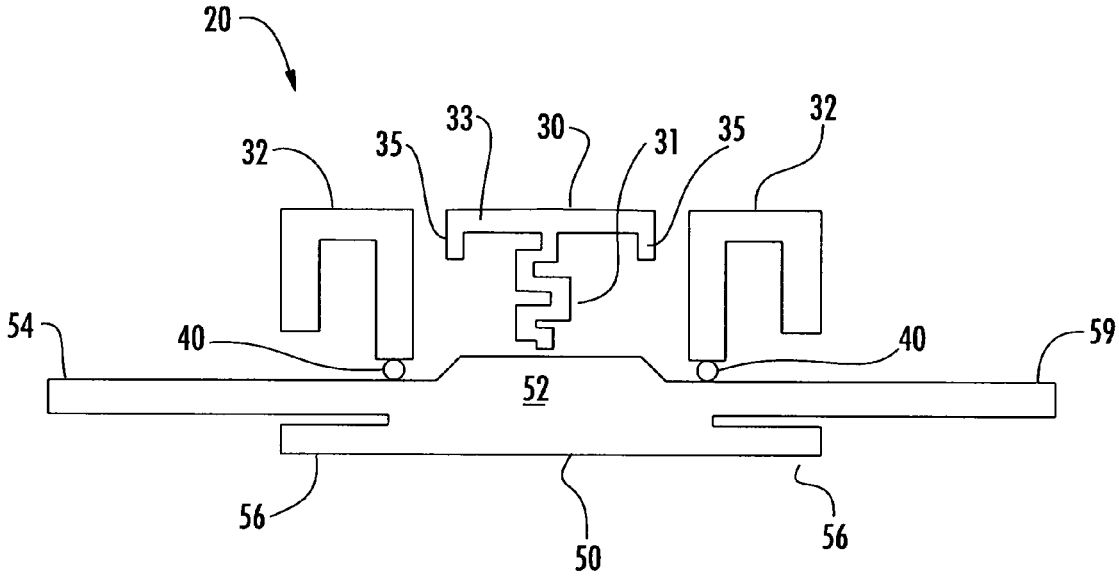
FIG. 3 is a schematic diagram of the smart antenna shown in FIGS. 1 and 2.

Referring initially to FIGS. 1, 2 and 3, a compact smart antenna 20 in accordance with the present invention provides for directional reception and transmission of radio communications signals with a base station in the case of a cell phone 22, or from an access point in the case of a PCMCIA card 24 by making use of wireless local area network (WLAN) protocols. As readily appreciated by those skilled in the art, the compact smart antenna 20 is not limited to a cell phone 22 or a PCMCIA card 22 and is applicable to other communications devices.

The active and passive antenna elements 30, 32 are protruding from the housing of the cell phone 22 as illustrated in FIG. 1. In other embodiments, the compact smart antenna 20 may be mounted internal the cell phone 22 so that the antenna elements 30, 32 are within the housing.

The compact smart antenna 20 comprises an active antenna element 30, a plurality of passive antenna elements 32 each comprising an inverted L-shaped portion laterally adjacent the active antenna element, and a plurality of impedance elements 40 selectively connectable to the plurality of passive antenna elements 32 for antenna beam steering.

A ground plane 50 comprises a center portion 52 adjacent the active antenna element 30, and a plurality of first and second arms 54, 56 extending outwardly from the center portion. Each first arm 54 is connected to a respective impedance element 40, and each second arm 56 is parallel to a corresponding first arm. Configuration of the first and second arms 54, 56 advantageously allow the overall height of the ground plane 50 to be reduced, which in turn, reduces the overall height of the smart antenna 20. In the illustrated embodiment, the compact smart antenna 20 has a width of about 3.5 inches and a height of about 0.8 inches for an operating frequency of 2.4 GHz.

The center portion 52 and the first arms 54 form the electrical ground plane of the smart antenna 20, and create a resonant structure. The first arms balance the passive antenna elements 32. Since the size and shape of the first arms 54 are resonant, they stop the current in the ground plane 50 from conducting any further, thus restricting the effect of human interaction. Another advantage of the first arms 54 being resonant is that the second arms 56 can be extended in length without significantly affecting the radiation pattern. This allows the smart antenna 20 to be more easily mounted to the end of a PCMCIA card circuit board 26 as illustrated in FIG. 2, for example.

The first arms 54 of the ground plane 50 are rectangular shaped and extend outwardly from the center portion 52 greater than a distance that the second arms 56 extend. The length that each first arm 54 extends outwardly from the center portion 52 of the ground plane 50 is substantially equal to the length of the corresponding passive antenna element 32 associated therewith. This creates a resonant structure with respect to the corresponding passive antenna element 32 associated therewith. Of course, there may be smart antenna 20 configurations where the length that each first arm 54 extends is not substantially equal to the length of the corresponding passive antenna element 32 associated therewith, as readily appreciated by those skilled in the art.

In addition, the ends of the first arms 54 may be L-shaped. In other words, the first arms 54 extend outwardly from the center portion 52 of the ground plane 50 and then turn at an angle downwards, for example.

To reduce the length that the first arms 54 extend outwardly from the center portion 52 of the ground plane 50, the first arms 54 may have other shapes. For example, the first arms 54 may have a meandering shape or a helix shape, for example.

Figure 4:
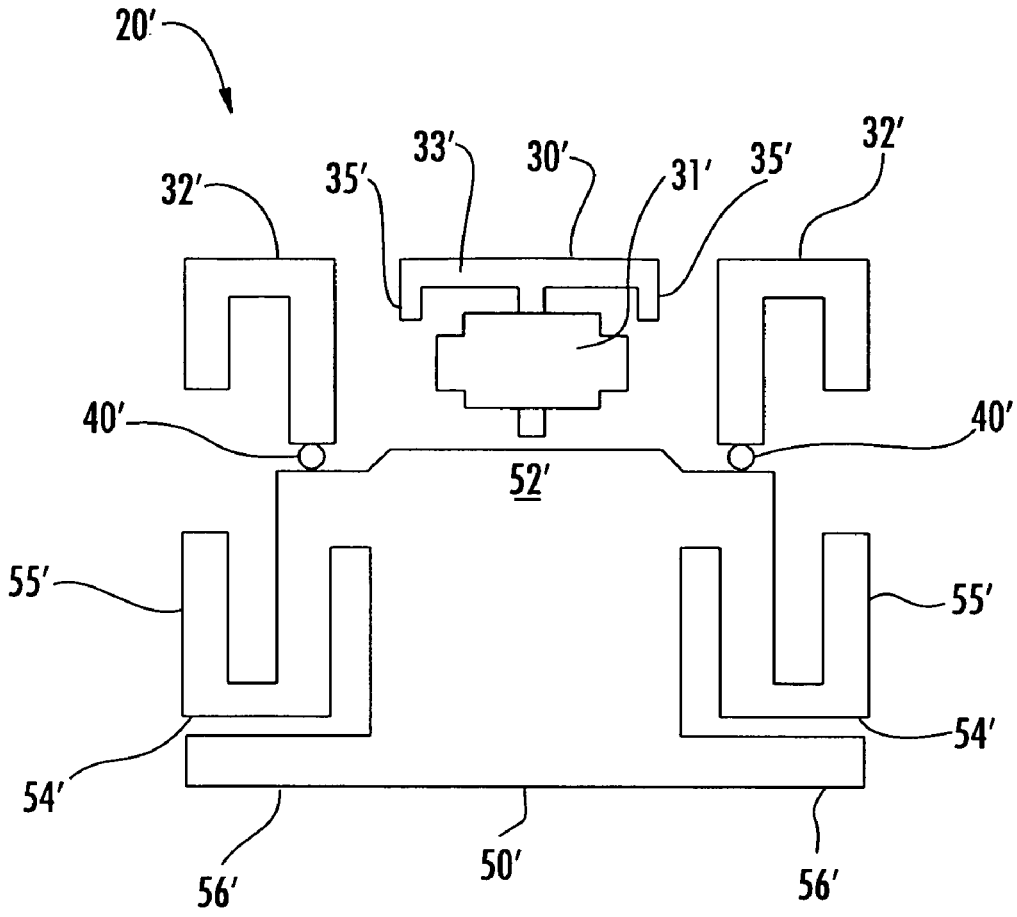
FIG. 4 is a schematic diagram of another embodiment of the smart antenna in accordance with the present invention.
Figure 5:
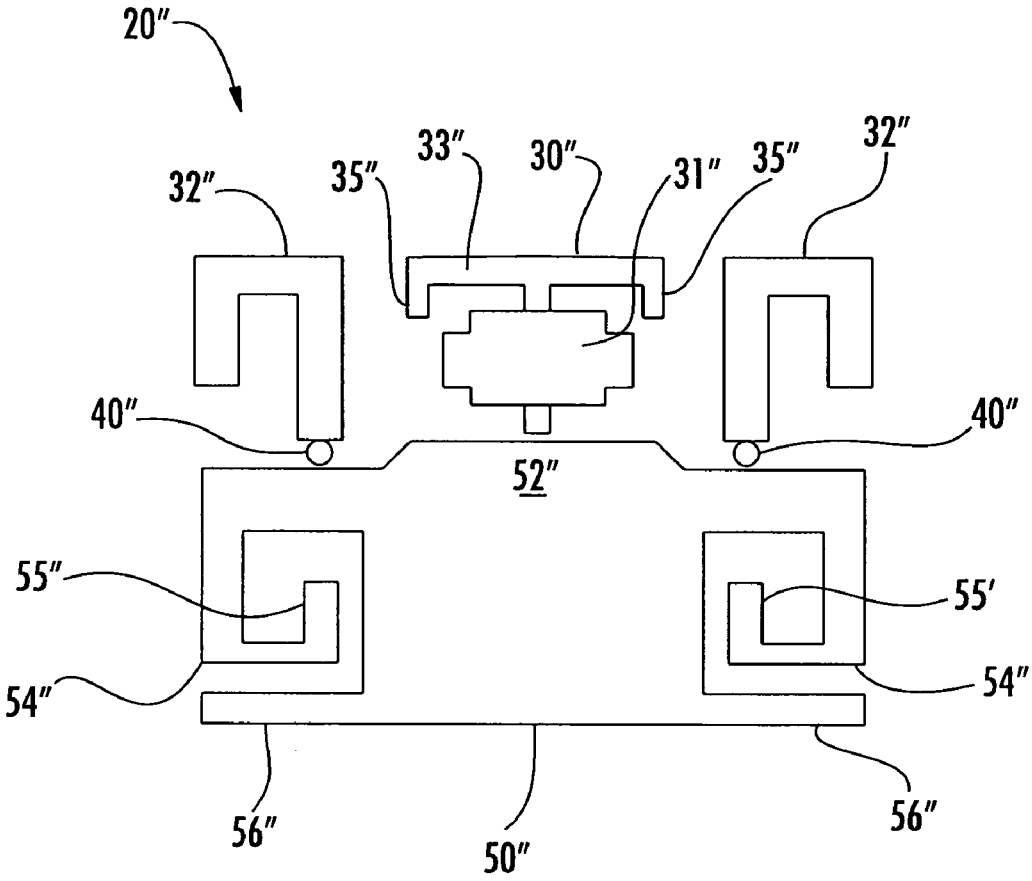
FIG. 5 is a schematic diagram of yet another embodiment of the smart antenna in accordance with the present invention.

In yet other embodiments, the first arms 54', 54" have an L-shape as illustrated in FIGS. 4 and 5. The first arm 54' as shown in FIG. 4 is a mirror image of the corresponding passive antenna element 32'. In contrast, the first arm 54" as shown in FIG. 5 is positioned opposite the corresponding passive antenna element 32". In these embodiments, the compact smart antennas 20', 20" have a width of about 1.9 inches and a height of about 1.2 inches for an operating frequency of 2.4 GHz. By adding an extension or load 55', 55" to an end of the L-shaped first arms 54', 54", the L-shape changes to a U-shape.

Even though the smart antennas 20', 20" shown in FIGS. 4 and 5 are not as compact as compared to the smart antenna 20 shown in FIG. 3, the L-shaped first arms 54', 54" provide a compact resonant structure for the passive antenna elements 32', 32". An advantage of the L-shaped first arms 54', 54" is that the smart antenna 20', 20" has a reduced width.

Figure 6:
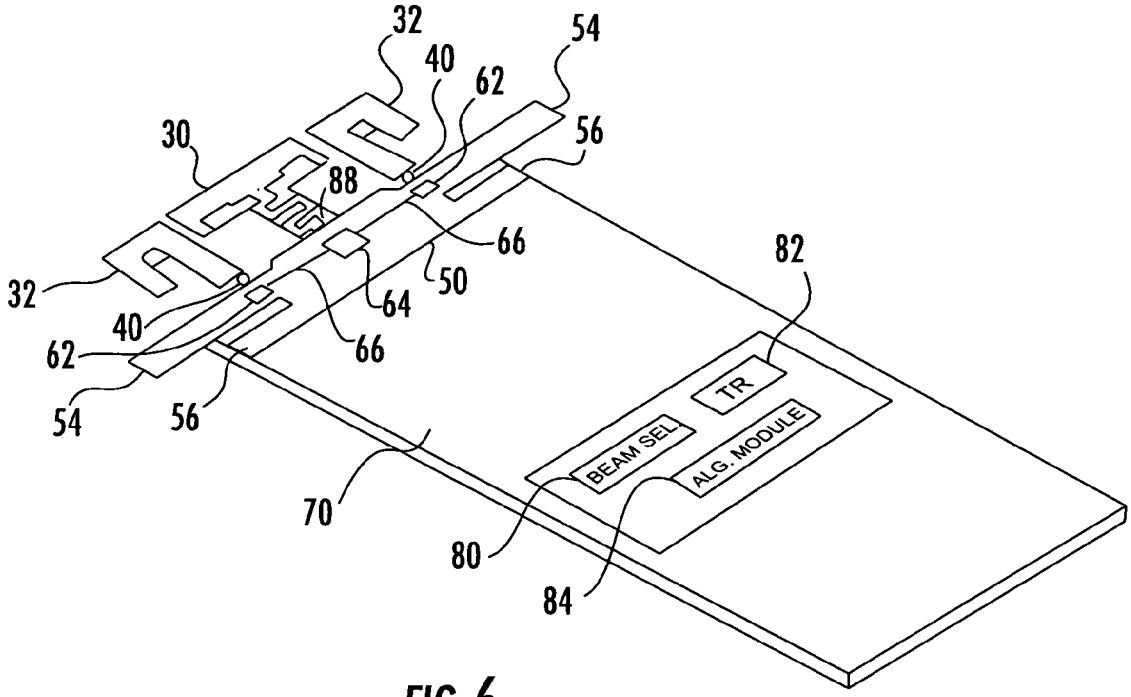
FIG. 6 is a schematic diagram of the smart antenna shown in FIG. 3 on a dielectric substrate in close proximity to other circuitry.
Figure 7:
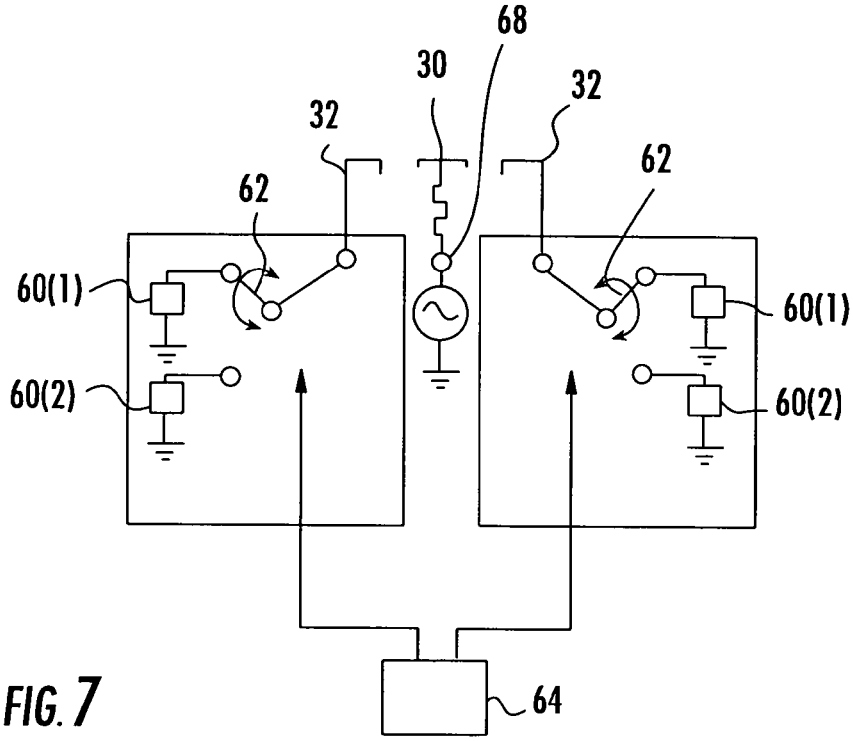
FIG. 7 is a schematic diagram of the switch and impedance elements for the passive antenna elements in accordance with the present invention.

The smart antenna 20 will now be discussed in greater detail with reference to FIGS. 6 and 7. The compact smart antenna 20 is disposed on a dielectric substrate 70 such as a printed circuit board, including the center active antenna element 30, the outer passive antenna elements 32, and the ground plane 50 including the first and second arms 54, 56. Each of the passive antenna elements 32 can be operated in a reflective or directive mode.

Since the illustrated smart antenna 20 is a compact antenna, the active antenna element 30 comprises a conductive radiator in the shape of a "T" disposed on the dielectric substrate 70. The passive antenna elements 32 are also disposed on the dielectric substrate 70, and each comprises an inverted L-shaped portion laterally adjacent the active antenna element 30. The T-shaped active antenna element 30 and the L-shaped portions of the passive antenna elements 32 advantageously reduce the overall height of the smart antenna 20.

Reduction in the length of the active antenna element 30 is accomplished by providing a top loading, and at the same time providing a slow wave structure for the body of the antenna. One of the technologies available for radiating element size reduction is meander-line technology. Other techniques can include dielectric loading, and corrugation, for example.

The active antenna element 30 shown in FIG. 3 includes a bottom portion 31 and a top portion 33 connected thereto for defining the T-shape. The bottom portion may have different embodiments, such as a meandering shape 31 as shown in FIG. 3, or a cross shape 31', 31" as shown in FIGS. 4 and 5, for example. The cross-shaped bottom portion 31', 31" of the active antenna element 30', 30" advantageously compensates for the reduction in the bandwidth of the smart antenna 20', 20" based upon reducing its size. In other words, the cross-shaped bottom portion 31', 31" supports a wider bandwidth for the compact smart antenna 20.

Regardless of the shape of the bottom portion 31 of the active antenna element 30, the top portion 33 is symmetrically arranged with respect to the bottom portion. The top portion 33 may also include a pair of inverted L-shaped ends 35.

Depending on the communications device, the first and second arms 54, 56 of the ground plane 50 may also be used with standard monopole shaped active and passive antenna elements 30 and 32, as readily appreciated by those skilled in the art. The active antenna element 30, the passive antenna elements 32 and the ground plane 50 are preferably fabricated from a single dielectric substrate such as a printed circuit board with the respective elements disposed thereon. The antenna elements 30, 32 and the ground plane 50 can also be disposed on a deformable or flexible substrate.

Even though two passive antenna elements 32 are illustrated, the compact smart antenna 20 may be configured with one passive antenna element. Consequently, the ground plane 50 would have a single first and second arm 54, 56 associated with the single passive antenna element 32. In other configurations, there may be more than two passive antenna elements 32, with first and second arms 54, 56 associated with a respective passive antenna element, as readily appreciated by those skilled in the art.

The height of the passive antenna elements 32 is reduced by bending the top portion thereof to produce the inverted L-shape. Alternatively, top loading may be used. The inverted L-shape is made to meet the top loading segment of the active antenna element 30, but not touching, in such a manner that more power can be coupled from the active antenna element 30 to the passive antenna elements 32 for optimum beam formation. The height of the active antenna element 30 and the passive antenna elements 32 shown in the figure is 0.5 inches, which corresponds to the smart antenna 20 operating at a frequency of about 2.4 GHz.

Gain is expected to be reduced when the physical size of the smart antenna 20 is reduced. Consequently, the first arms 54 compensate for this loss. This in effect turns the passive antenna elements 32 into offset fed dipoles. The passive antenna elements 32 perform as reflector/director elements with controllable amplitude and phase.

For a passive antenna element 32 to operate in either a reflective or directive mode, the passive antenna element 32 is connected to the first arm 54 via at least one impedance element 60. The at least one impedance element 60 comprises a capacitive load 60(1) and an inductive load 60(2), and each load is connected between the passive antenna elements 32 via a switch 62. The switch 62 may be a single pole, double throw switch, for example.

When the passive antenna element 32 is connected to a respective first arm 54 via the inductive load 60(2), the passive antenna element 32 operates in a reflective mode. This results in radio frequency (RF) energy being reflected back from the passive antenna element 32 towards its source, i.e., the active antenna element 30.

When the passive antenna element 32 is connected to a respective first arm 54 via the capacitive load 60(1), the passive antenna element 32 operates in a directive mode. This results in RF energy being directed toward the passive antenna element 32 away from the active antenna element 30.

A switch control and driver circuit 64 provides logic control signals to each of the respective switches 62 via conductive traces 66. The switches 62, the switch control and driver circuit 64 and the conductive traces 66 may be on the same dielectric substrate 40 as the antenna elements 30, 32.

The electronic circuitry, radio reception and transmission equipment for the communications device operating with the compact smart antenna 20 may be on the same or different modules. Alternatively, this equipment may be on the same dielectric substrate 70 as the smart antenna 20. As illustrated in FIG. 6, this equipment includes a beam selector 80 for selecting the antenna beams, and a transceiver 82 coupled to a feed 88 of the active antenna element 30.

An antenna steering algorithm module 84 runs an antenna steering algorithm for determining which antenna beam provides the best reception. The antenna steering algorithm operates the beam selector 80 for scanning the plurality of antenna beams for receiving signals.

Since a two-position switch 62 is used for each of the two passive antenna elements 32, four antenna modes are available. In other words, each switching combination corresponds to a different antenna mode. The input impedance to the active antenna element changes between the difference antenna modes. Ideally, the input impedance is 50 ohms.

Figure 8:
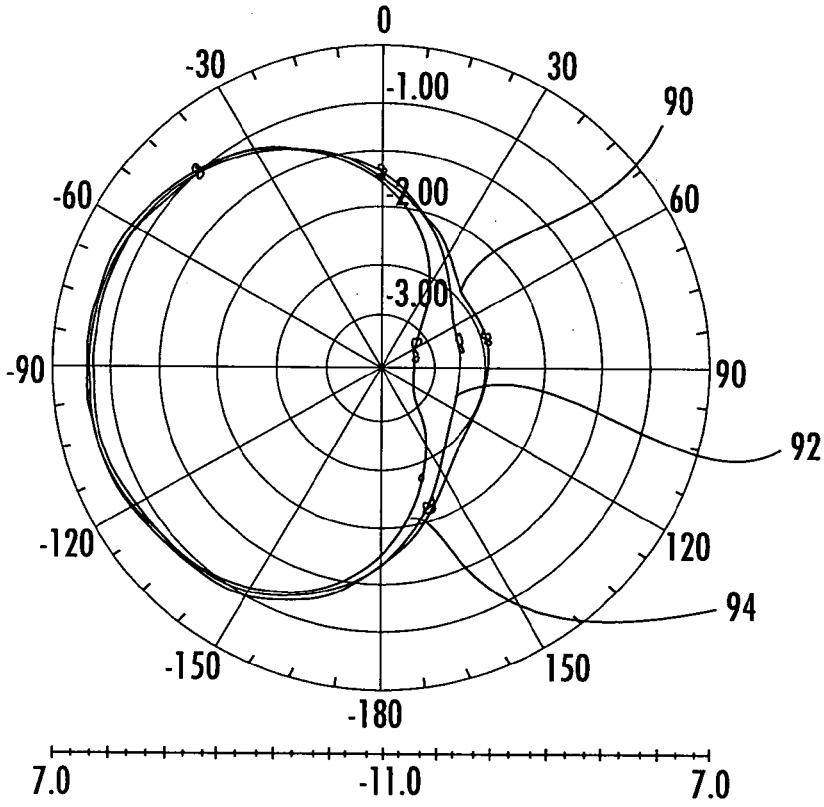
FIG. 8 is a graph illustrating antenna patterns for the same antenna mode at different operating frequencies for the smart antenna shown in FIG. 1.

A graph illustrating antenna patterns for the same antenna mode at different operating frequencies for the compact smart antenna 20 is provided in FIG. 8. The antenna patterns correspond to a "left beam" mode. In particular, antenna pattern 90 corresponds to an operating frequency of 2.4 GHz, antenna pattern 92 corresponds to an operating frequency of 2.45 GHz, and antenna pattern 94 corresponds to an operating frequency of 2.5 GHz.

Yet another aspect of the present invention is to provide a method for making a smart antenna 20 comprising forming at least one passive antenna element 32 laterally adjacent an active antenna element 30, and forming at least one impedance element 60 selectively connectable to the at least one passive antenna element for antenna beam steering. The method further comprises forming a ground plane 50 comprising a center portion 52 adjacent the active antenna element 30, at least one first arm 54 extending outwardly from the center portion and connected to the at least one impedance element 60. At least one second arm 56 is laterally adjacent the at least one first arm 54 and extends outwardly from the center portion.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

That which is claimed is:

1. A smart antenna comprising:

an active antenna element;

at least one passive antenna element laterally adjacent said active antenna element;

at least one impedance element selectively connectable to said at least one passive antenna element for antenna beam steering; and a ground plane comprising a center portion adjacent said active antenna element, at least one first arm extending outwardly from said center portion and connected to said at least one impedance element, and at least one second arm laterally adjacent said at least one first arm and extending outwardly from said center portion.

2. A smart antenna according to claim 1 wherein said at least one first and second arms are parallel to one another.

3. A smart antenna according to claim 1 wherein said at least one first and second arms are both orthogonal to said at least one passive element.

4. A smart antenna according to claim 1 wherein said at least one first arm extends outwardly from said center portion greater than said at least one second arm.

5. A smart antenna according to claim 1 wherein said at least one first and second arms both have a rectangular shape.

6. A smart antenna according to claim 1 wherein said at least one first arm has a meandering shape.

7. A smart antenna according to claim 1 wherein said at least one first arm has a helix shape.

8. A smart antenna according to claim 1 wherein said at least one first arm has an L-shape.

9. A smart antenna according to claim 8 wherein said at least one first arm comprises a first portion connected to said at least one impedance element and a second portion connected thereto for defining the L-shape, and wherein the second portion includes an inverted L-shaped end.

10. A smart antenna according to claim 1 further comprising at least one switch for selectively connecting said at least one passive antenna element to said at least one impedance element.

11. A smart antenna according to claim 1 wherein each impedance element is associated with a respective passive antenna element, each impedance element comprising an inductive load and a capacitive load, with said inductive load and said capacitive load being selectively connectable to the respective passive antenna element.

12. A smart antenna according to claim 1 wherein said active antenna element has a T-shape.

13. A smart antenna according to claim 12 wherein said active antenna element includes a bottom portion and a top portion connected thereto for defining the T-shape, and wherein the bottom portion has a cross shape.

14. A smart antenna according to claim 12 wherein said active antenna element includes a bottom portion and a top portion connected thereto for defining the T-shape, and wherein the bottom portion has a meandering shape.

15. A smart antenna according to claim 14 wherein the top portion is symmetrically arranged with respect to the bottom portion, and includes a pair of inverted L-shaped ends.

16. A smart antenna according to claim 1 wherein said at least one passive antenna element comprises an inverted L-shaped portion laterally adjacent said active antenna element.

17. A smart antenna according to claim 1 further comprising a dielectric substrate; and wherein said active antenna element, said at least one passive antenna element, said at least one impedance element and said ground plane are on said dielectric substrate.

18. A communications device comprising:

a smart antenna for generating a plurality of antenna beams;

a beam selector controller connected to said smart antenna for selecting one of said plurality of antenna beams; and a transceiver connected to said beam selector and to said smart antenna;

said smart antenna comprising an active antenna element, at least one passive antenna element laterally adjacent said active antenna element, at least one impedance element selectively connectable to said at least one passive antenna element for antenna beam steering, and a ground plane comprising a center portion adjacent said active antenna element, at least one first arm extending outwardly from said center portion and connected to said at least one impedance element, and at least one second arm laterally adjacent said at least one first arm and extending outwardly from said center portion.

19. A communications device according to claim 18 wherein said at least one first and second arms are parallel to one another.

20. A communications device according to claim 18 wherein said at least one first arm extends outwardly from said center portion greater than said at least one second arm.

21. A communications device according to claim 18 wherein said at least one first arm has an L-shape.

22. A communications device according to claim 21 wherein said at least one first arm comprises a first portion connected to said at least one impedance element and a second portion connected thereto for defining the L-shape, and wherein the second portion includes an inverted L-shaped end.

23. A communications device according to claim 18 wherein said smart antenna further comprises at least one switch for selectively connecting said at least one passive antenna element to said at least one impedance element.

24. A communications device according to claim 18 wherein said active antenna element has a T-shape.

25. A communications device according to claim 18 wherein said at least one passive antenna element comprises an inverted L-shaped portion laterally adjacent said active antenna element.

26. A communications device according to claim 18 wherein said smart antenna, said beam selector controller and said transceiver are configured so that the communications device is a cell phone.

27. A communications device according to claim 18 wherein said smart antenna, said beam selector controller and said transceiver are configured so that the communications device is a PCMCIA card.

28. A method for making a smart antenna comprising:

forming at least one passive antenna element laterally adjacent an active antenna element;

forming at least one impedance element selectively connectable to the at least one passive antenna element for antenna beam steering; and forming a ground plane comprising a center portion adjacent the active antenna element, at least one first arm extending outwardly from the center portion and connected to the at least one impedance element, and at least one second arm laterally adjacent the at least one first arm and extending outwardly from the center portion.

29. A method according to claim 28 wherein the at least one first and second arms are formed parallel to one another.

30. A method according to claim 28 wherein the at least one first arm extends outwardly from the center portion greater than the at least one second arm.

31. A method according to claim 28 wherein the at least one first arm has an L-shape.

32. A method according to claim 31 wherein the at least one first arm comprises a first portion connected to the at least one impedance element and a second portion connected thereto for defining the L-shape, and wherein the second portion includes an inverted L-shaped end.

33. A method according to claim 28 wherein the smart antenna further comprises at least one switch for selectively connecting the at least one passive antenna element to the at least one impedance element.

34. A method according to claim 28 wherein the active antenna element has a T-shape.

35. A method according to claim 28 wherein the at least one passive antenna element comprises an inverted L-shaped portion laterally adjacent the active antenna element.

* * * * *